US010583622B2

(12) United States Patent
Sobota et al.

(10) Patent No.: US 10,583,622 B2
(45) Date of Patent: Mar. 10, 2020

(54) APPARATUS AND A METHOD FOR DEWATERING WOOD CHIPS

(71) Applicant: COPOLIA COMPANY SA, Villars-sur-Glane (CH)

(72) Inventors: Ernest Stefan Georg Sobota, Sachseln (CH); Carl Johan Ingvar Karlsson, Karlstad (SE)

(73) Assignee: COPOLIA COMPANY SA, Villars-sur-Glane (CH)

( * ) Notice: Subject to any disclaimer, the term of this patent is extended or adjusted under 35 U.S.C. 154(b) by 276 days.

(21) Appl. No.: 14/424,630

(22) PCT Filed: Aug. 28, 2013

(86) PCT No.: PCT/EP2013/067793
§ 371 (c)(1),
(2) Date: Feb. 27, 2015

(87) PCT Pub. No.: WO2014/033156
PCT Pub. Date: Mar. 6, 2014

(65) Prior Publication Data

US 2015/0217530 A1 Aug. 6, 2015

(30) Foreign Application Priority Data

Aug. 28, 2012 (SE) ..... 1250958

(51) Int. Cl.
*B30B 9/24* (2006.01)
*F26B 5/12* (2006.01)
(Continued)

(52) U.S. Cl.
CPC ..... *B30B 9/20* (2013.01); *B30B 9/24* (2013.01); *B30B 9/241* (2013.01); *B30B 9/243* (2013.01);
(Continued)

(58) Field of Classification Search
CPC .. B30B 9/20; B30B 9/24; B30B 9/241; B30B 9/243; B30B 5/04; B30B 13/00; F26B 5/12; F26B 17/04; F26B 2200/24
(Continued)

(56) References Cited

U.S. PATENT DOCUMENTS 2,323,918 A * 7/1943 Kiernan ..... D21J 1/00 15/DIG. 7
2,858,747 A * 11/1958 Wagner ..... D21F 3/0272 100/106
(Continued)

FOREIGN PATENT DOCUMENTS

DE 4101856 C1 7/1992
GB 220015 A 8/1924
(Continued)

OTHER PUBLICATIONS

Yoshida et al.—Dewatering of Wood Chips by Roller.*
(Continued)

*Primary Examiner* — Jimmy T Nguyen
(74) *Attorney, Agent, or Firm* — John M. Harrington, Esq.; Johnson, Marcou, Isaacs & Nix, LLC

(57) ABSTRACT

An apparatus (1) and a method for dewatering wood material (2). The apparatus (1) includes a first roll (3) and a second roll (4) that form a nip (N i) in which water can be pressed out of the wood chips (2). An endless permeable conveyor (5) is arranged to pass through the nip (Ni) and carry wood chips (2) through the (Ni).

7 Claims, 10 Drawing Sheets

(51) Int. Cl.

| | |
|---|---|
| ***F26B 5/14*** | (2006.01) |
| ***F26B 17/04*** | (2006.01) |
| ***B30B 13/00*** | (2006.01) |
| ***B30B 9/20*** | (2006.01) |

(52) U.S. Cl.
CPC ..... *B30B 13/00* (2013.01); *F26B 5/12* (2013.01); *F26B 5/14* (2013.01); *F26B 17/04* (2013.01); *F26B 2200/24* (2013.01)

(58) Field of Classification Search
USPC ..... 100/37, 118, 151, 153
See application file for complete search history.

(56) References Cited

U.S. PATENT DOCUMENTS

| | | | | | |
|---|---|---|---|---|---|
| 2,987,988 | A * | 6/1961 | Robledano | B30B 9/241 | 100/118 |
| 4,752,316 | A * | 6/1988 | Plovanich | B30B 9/20 | 71/11 |
| 5,471,921 | A * | 12/1995 | Kubat | B30B 9/20 | 100/106 |
| 5,560,410 | A * | 10/1996 | Peacock | B27M 1/02 | 100/176 |

FOREIGN PATENT DOCUMENTS

| | | | | |
|---|---|---|---|---|
| GB | 2090954 | | 7/1982 | |
| GB | 2090954 | A * | 7/1982 | B30B 9/207 |
| GB | 2090954 | A * | 7/1982 | B30B 9/207 |
| GB | 220015 | | 10/2002 | |

OTHER PUBLICATIONS

Fyer et al.—Steam Drying of Wood Chips.*
Google Pressure to Linear Load Conversion.*
Fyhr et al.—Steam Drying of Wood Chips.*
Google Conversions, printed Jun. 24, 2018.*
Biomass and Bioenergy 34, 2010, pp. 1053-1058; Yoshida ; Apr. 8, 2010 (Year: 2010).*
Chinese Office Action for counterpart Chinese Patent Application No. 201380051604.2, dated Jun. 15, 2016, 6 pages (English translation included).
New Zealand Office Action for co-pending New Zealand Patent Application No. 705248, dated Jul. 28, 2016, 2.
Office Action for counterpart Chinese Patent Application No. 201380051604.2 (English translation included), dated Dec. 23, 2016, 8.
International Search Report and Written Opinion dated Nov. 19, 2013 for PCT/EP2013/067793, 11 pages.
Yoshida et al, "Dewatering of High-Moisture Wood Chips by Roller Compression Method," Biomass and Bioenergy, Jul. 1, 2010, vol. 34, No. 7, pp. 1053-1058.
Chinese Office Action dated Nov. 18, 2015 for counterpart Chinese Patent Application No. 201380051604.2, English translation included, 8 pages.
Yoshida, et al., "Dewatering of High-Moisture Wood Chips by Roller Compression Method", Biomass and Bioenergy, Jul. 1, 2010, 1053-1058.
European Office Action for European Patent Application No. 13753189.3, dated May 22, 2017, 6.

* cited by examiner

APPARATUS AND A METHOD FOR DEWATERING WOOD CHIPS

CROSS REFERENCE TO RELATED APPLICATIONS

This application is a 35 U.S.C. § 371 national stage of International Application No. PCT/EP2013/067793 filed on Aug. 28, 2013, published in English under PCT Article 21(2), which claims the benefit of priority to Swedish Patent Application No. 1250958-4 filed on Aug. 28, 2012, the disclosures of which are hereby incorporated by reference.

FIELD OF THE INVENTION

The present invention relates to an apparatus and a method in which wood chips are dewatered in a nip formed between rolls.

BACKGROUND OF THE INVENTION

In order to use wood a source of energy, wood chips can be dewatered and subsequently used as fuel. To remove water from the wood chips, the wood chips may be subjected to heat that causes moisture in the wood chips to evaporate. However, such methods are time-consuming and require large amounts of energy which makes such methods less effective in terms of energy economy. A method which is more economical in terms of energy economy is to dewater the wood chips by means of compression. In an article published 2010 by "ScienceDirect", Dewatering of high-moisture wood chips by roller compression method (Takahiro Yoshida, Hiroyuki Sasaki, Tsutomu Takano and Osamu Sawabe), a method of dewatering wood chips by roller compression was disclosed. In that article, a method was described in which wood chips were compressed between rolls. The article discloses an apparatus with a primary and a secondary unit that both included rollers. The secondary unit had a lower roller with holes having a diameter of 6 mm that were intended to allow squeezed-out water into an aspiration funnel attached inside the roller. The water was reportedly expelled by an exhaustion fan attached to the back of the apparatus. A stainless steel wire mesh belt around the lower roller allowed water to flow from the chips to the holes. The chips included cedar and cypress chips. Wood chips were dewatered at pressures of 10, 20 and 30 MPa. It was found that roller compression can remove water from wood chips with low energy consumption.

GB 2090954 A discloses a method and an apparatus in which wood chips are dewatered between two endless conveyors between which the wood chips are squeezed. One of the conveyors is a perforated conveyor and a suction means may be provided for applying a reduced pressure or vacuum to the underside of the perforated conveyor.

When compression has been used to dewater wood chips, the effect has not always met expectations. Therefore, it is an object of the present invention to improve processes in which dewatering of wood chips is carried out by means of compression. In particular, it is an object of the invention to provide an apparatus and a method in which a high degree of dewatering can be achieved such that the moisture content after pressing will be low.

DISCLOSURE OF THE INVENTION

The inventive apparatus comprises a first roll and a second roll that form a first nip in which water can be pressed out of the wood material, e.g. chips. The apparatus also comprises an endless conveyor which is permeable to water and forms a loop around the first roll. The endless conveyor is formed by a metal band having high strength and arranged to pass through the first nip such that the endless conveyor can carry the wood material through the first nip.

The wood material is preferably spread on the band to form at least 2 layers on top of the belt, and if wood chips preferably 2-5 layers, to form a relatively tight mat, i.e. substantially without open through holes, in order to achieve an efficient dewatering of all individual wood particles, e.g. chips.

At least one suction device may be located inside the loop of the endless conveyor and is arranged to suck water through the endless conveyor when water is pressed out of the wood chips in the nip. The at least one suction device extends in a direction parallel to the axis of the first roll and is positioned such that it sealingly engages an outer surface of the first roll such that, a delimited suction zone is formed in the area between the at least one suction device, the outer surface of the first roll and the endless conveyor. In the delimited suction zone, water that has been pressed out of the wood chips in the first nip can be sucked through the endless conveyor.

In advantageous embodiments of the invention, the suction device sealingly engages the outer surface of the first roll by means of a first seal that extends in the axial direction of the roll (which is also the axial direction of the suction device). Preferably, the first seal extends over the entire axial length of the first roll.

Optionally, the inventive apparatus may comprise a suction device on each side of the first nip in the direction of movement of the endless conveyor.

In embodiments of the invention, the at least one suction device is further provided with a seal on at least one of its axial ends. Such a seal that is located at an axial end of the suction device may be arranged to engage a circumferential groove in the first roll.

The endless conveyor may advantageously be a metal band, preferably a steel band with a thickness in the range of 0.3 mm-2.5 mm, preferably a thickness in the range of 0.4 mm-2 mm. Other materials and dimensions are conceivable. For example, a conveyor made in a plastic material can be considered and steel bands with a thickness greater than 2.5 mm or less than 0.3 mm may be considered. The endless conveyor may be made in a non-metallic material, for example a plastic material but a metal band/metal belt is preferred since it will have a higher resistance to the wear and the high forces to which the endless conveyor will be subjected during operation. It is to be expected that a metal band will last longer than an endless conveyor made of a plastic material and that a metal band can take higher loads. In principle, an endless conveyor made of a textile material may be considered although it is to be expected that a textile material would not last very long.

The endless conveyor preferably has perforations with a diameter in the range of 0.5 mm-5.0 mm, preferably in the range of 1.0 mm-5.0 mm. Embodiments are conceivable in which the perforations have a diameter that exceeds 5.0 mm or in which the diameter is less than 0.5 mm.

The perforations preferably have a circular shape/form. However, the perforations could have a non-circular shape, for example an elliptic, triangular or rectangular shape. The endless conveyor may advantageously have an open area in the range of 10%-50%, preferable an open area in the range of 15%-45% and even more preferred an open area in the range of 25%-40%.

If the endless conveyor is a metal band/metal belt, it should preferably be made of stainless steel but other metal materials are conceivable, for example copper.

In advantageous embodiments of the invention, a cleaning device for the endless conveyor may be placed inside the loop of the endless conveyor and arranged to act on the endless conveyor to remove debris from the endless conveyor and thereby counteract clogging.

The apparatus may optionally further comprise a third roll arranged within the loop of the endless conveyor and a fourth roll outside the loop of the endless conveyor and arranged to form a second nip with the third roll to press water out of wood chips that are passed on the endless conveyor through the second nip.

In advantageous embodiments of the invention, the endless conveyor is arranged to be driven. The fourth roll may then optionally be arranged to be driven with such a speed that its peripheral speed exceeds the speed of the endless conveyor.

The invention also relates to a method of dewatering wood chips. The inventive method comprises passing the wood whips through at least a first nip formed between a first roll and a second roll such that water in the wood chips is pressed out of the wood chips when the wood chips pass through the first nip. In the inventive method, the wood chips are carried through the first nip on an endless conveyor which is permeable to water and forms a loop around the first roll. In embodiments of the invention, water that has been pressed out of the wood chips is sucked through the endless conveyor by a suction device which is located inside the loop of the endless conveyor and extends in a direction parallel to the axis of the first roll. The suction device is positioned/arranged such that it sealingly engages an outer surface of the first roll such that a delimited suction zone is formed in the area between the at least one suction device, the outer surface of the first roll and the endless conveyor and the suction device is operated during pressing such that an underpressure is generated.

In advantageous embodiments of the method, the suction device may have a seal that extends in the axial direction of the first roll such that this axially extending seal meets/engages the outer surface of the first roll.

During operation, the endless conveyor may suitably have a speed in the range of 0.3 m/s-10 m/s, preferably a speed in the range of 0.6 m/s-5 m/s but speeds outside these ranges are conceivable.

Suitably, a linear load is applied in the nip which is in the range of 500 kN/m-4000 kN/m, preferably in the range of 800 kN/m-3000 kN/m, more preferred 1000-2500 kN/m. Linear loads higher than 4000 kN/m or lower than 500 kN/m may be conceivable.

Advantageously, the inventive method may include operating a cleaning device inside the loop of the endless conveyor in order to remove debris from the endless conveyor. Embodiments of the inventive method are conceivable in which such a cleaning device is not used.

In embodiments of the inventive method, the endless conveyor may optionally pass through a second nip arranged downstream of the first nip. Such a second nip may be formed by a third roll positioned inside the loop of the endless conveyor and a fourth roll positioned outside the loop of the endless conveyor. In such embodiments, the fourth roll may optionally be driven with such a speed that the peripheral speed of the fourth roll exceeds the speed of the endless conveyor.

DETAILED DISCLOSURE OF THE INVENTION

Figure 1:
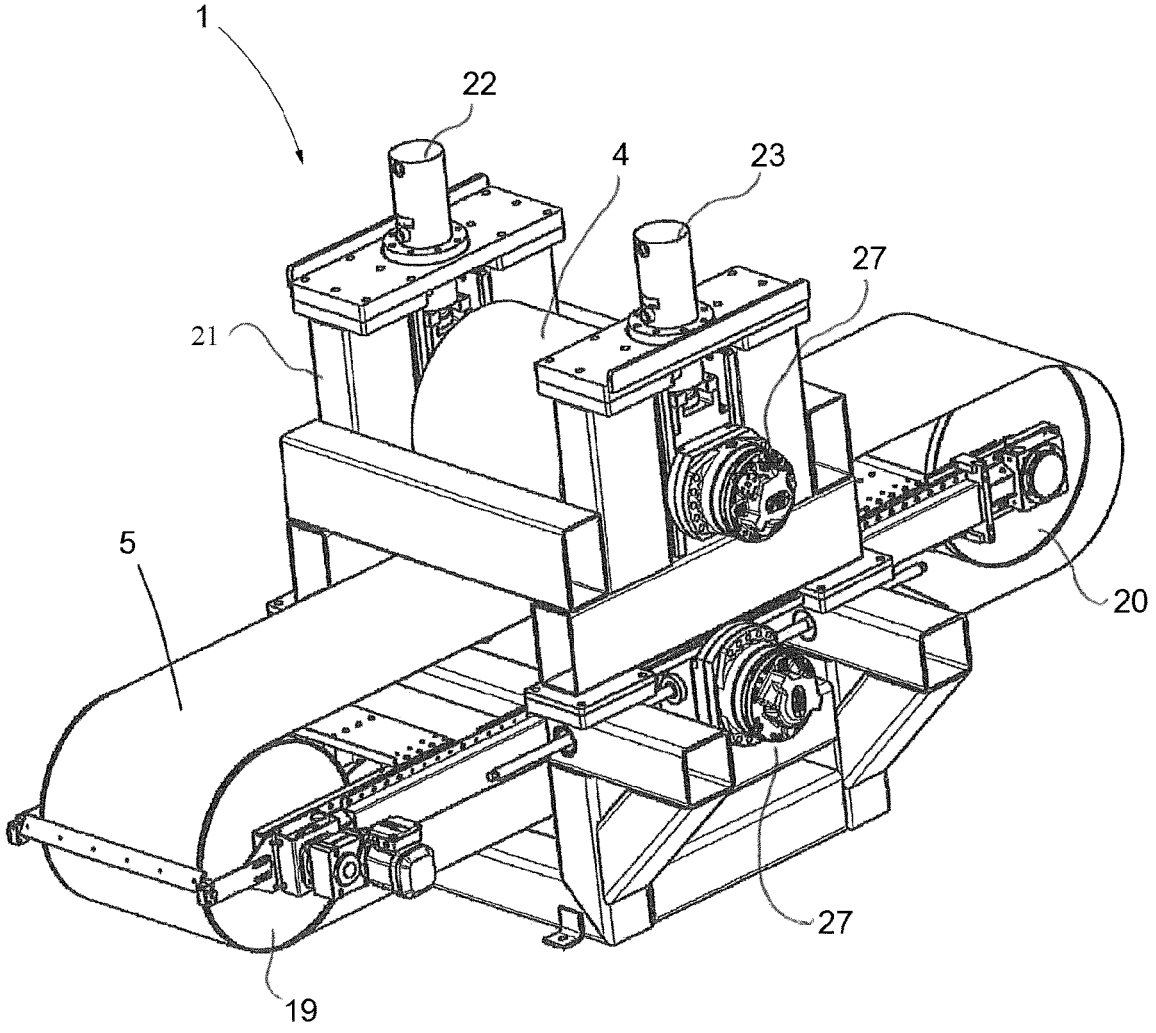
FIG. 1 shows an embodiment of the inventive apparatus in perspective.
Figure 7:
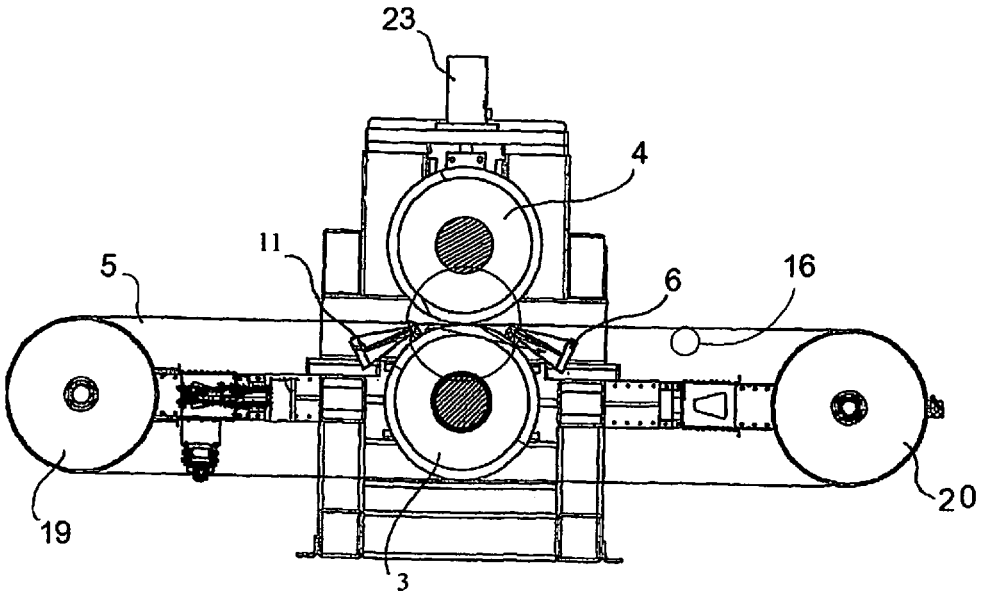
FIG. 7 is a cross-sectional side view of the embodiment shown in FIG. 1.

With reference to FIG. 1, FIG. 2, FIG. 4, FIG. 7, FIG. 8*a* and FIG. 8*b*, the invention relates to an apparatus for dewatering wood chips 2. The apparatus 1 comprises a first roll 3 and a second roll 4 that form at least a first nip $N_1$. As best seen in FIG. 7, wood chips 2 are passed into the first nip $N_1$ such that water can be pressed out of the wood chips 2. The rolls 3, 4 may be journalled in a roll stand 21 as shown in FIG. 1 and FIG. 7. As indicated in FIG. 1, actuators 22, 23 (for example hydraulic actuators) may suitable be arranged to force the second roll 4 against the first roll 3 such that the first nip $N_1$ is loaded and wood chips 2 that pass through the first nip $N_1$ will be compressed by the force in the nip. One of the rolls 3, 4 or both rolls 3, 4 may be provided with a drive for driving the roll. In FIG. 1, the reference numeral 27 may indicate a drive for a roll 3, 4 or a connection to a drive for a roll 3, 4.

Larger wood pieces have previously been cut into wood chips 2 (see FIG. 8*a*) that are to be dewatered in the inventive machine 1. The wood that has been cut to wood chips 2 may be, for example, trunks from trees, branches of trees or roots from trees. In many practical applications, the wood chips 2 may be of a size on the order of about 5 mm-20 mm (length, thickness, width) but other dimensions are also possible. It should be understood that the raw material (the wood chips) may also be pieces of wood (such as small twigs) that are already so small that they need not be cut into smaller pieces before they are processed in the inventive machine 1. For example in a test carried out with the inventive method/machine, whole tops of trees were successfully processed.

Figure 8A:
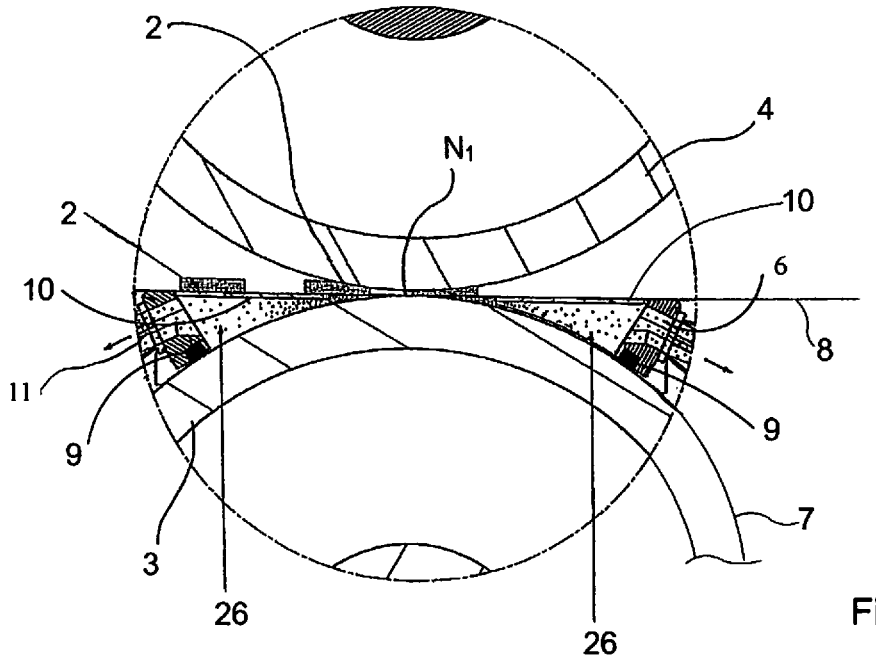
FIG. 8*a* is an enlargement of a part of FIG. 7.

As can be seen in FIG. 1, FIG. 7 and FIG. 8*a*, the apparatus also comprises an endless conveyor 5 on which the wood chips 2 can be transported into the first nip $N_1$. The wood material is preferably spread on the band to form at least 2 layers on top of the conveyer 5, and if wood chips preferably 2-5 layers, to form a relatively tight mat, i.e. substantially without open through holes, in order to achieve an efficient dewatering of all individual wood particles, e.g. chips. The conveyor 5 is permeable to water and forms a loop around the first roll 3 and is arranged to pass through the first nip $N_1$ such that the endless conveyor 5 can carry wood chips 2 through the first nip $N_1$. The endless conveyor 5 is preferably a metal band/metal belt. Different metal materials can be considered for the endless conveyor 5. For example, the endless conveyor 5 can be made of copper or steel. Preferably, the endless conveyor 5 is a stainless steel belt (band). For example, the endless conveyor 5 may be a martensitic stainless steel belt, preferably a precipitation hardened steel having a relatively high strength (e.g. above 1500 MPA) and hardness (e.g. above 450 $HV_5$). A suitable belt grade is marketed by SANDVIK AB (Sandviken, Sweden) under the name Sandvik 1600SM which is said to be a belt grade made of low carbon, martensitic precipitation hardened, stainless steel. The skilled person may consider what other metal materials that could possibly be used, bearing in mind that a suitable metal material should be able to resist wear and be strong enough to allow high pressing forces to be used.

The endless conveyor 5 may run around rolls 19, 20 located at the ends of the loop formed by the endless conveyor 5. One of the rolls 19, 20 may optionally be a drive roll that drives the endless conveyor 5. Optionally, both rolls 19, 20 may be drive rolls. As best seen in FIG. 8*a*, at least one suction device 6 is located inside the loop of the endless conveyor 5. The suction device 6 is arranged to suck water through the endless conveyor 5 when water is pressed out of the wood chips 2 in the nip $N_1$. With reference to FIG. 8*a*, the suction device 6 may have an axially extending seal 9 that engages an outer surface 7 of the first roll 3 such that the suction device 6 sealingly engages the first roll 3. The axially extending seal 9 is substantially parallel with the axis of the first roll 3 and is arranged to seal against the first roll 3. The axially extending seal 9 may be made of different materials. In an embodiment contemplated by the inventors, the axially extending seal 9 may be made of rubber (wholly or in part). In other embodiments contemplated by the inventors, the axially extending seal 9 may be made of a fibre or textile material and treated with PTFE (Teflon) but other materials may also be considered.

Figure 8B:
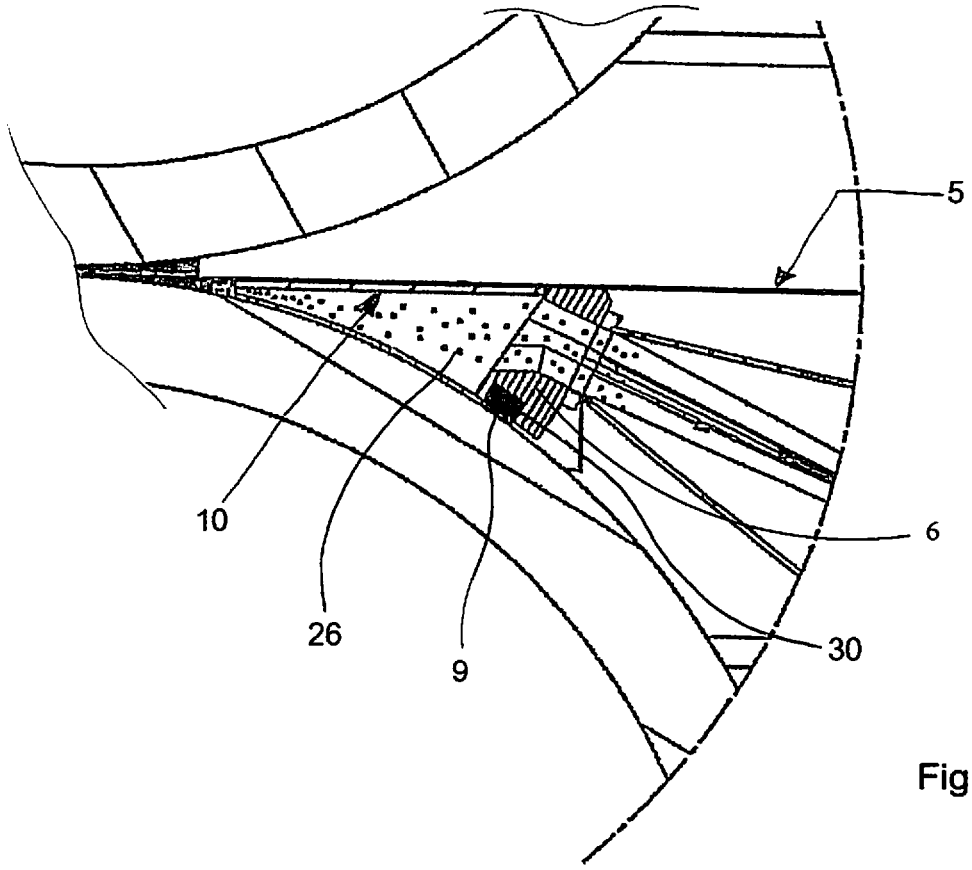
FIG. 8*b* is a further enlargement of a part of FIG. 8*a*.

With reference to FIG. 8*a*, the suction device 6 may optionally have a cover (lid) 10 that extends towards the first nip $N_1$ parallel to or substantially parallel to the endless conveyor 5. The cover or lid 10 does ends at some distance from the opening of the first nip $N_1$. In embodiments contemplated by the inventors, the cover 10 may extend to a point 50 mm-150 mm from the first nip $N_1$. As can be seen in FIG. 8*a*, a delimited suction zone 26 is formed in the area between the at least one suction device 6, the outer surface 7 of the first roll 3 and the endless conveyor 5. The cover 10 may contribute to delimiting this suction zone 26 but it should be understood that embodiments are conceivable in which the suction device 6 does not have such a cover 10. In such embodiments, the endless conveyor 5 will form a ceiling for the delimited suction zone 26. In operation, the endless conveyor 5 will run over the at least one suction device 6 and, due to the underpressure, normally be lightly pressed against the at least one suction device 6 such that the suction device will engage both the first roll 3 and the endless conveyor 5. The cover 10 can also be seen more clearly in FIG. 8*b* where it can be seen how the endless conveyor runs on top of the cover 10. In FIG. 8*b*, it can also be seen how the axially extending seal 9 is placed in a groove 30 in the body of the suction device 6.

Figure 4:
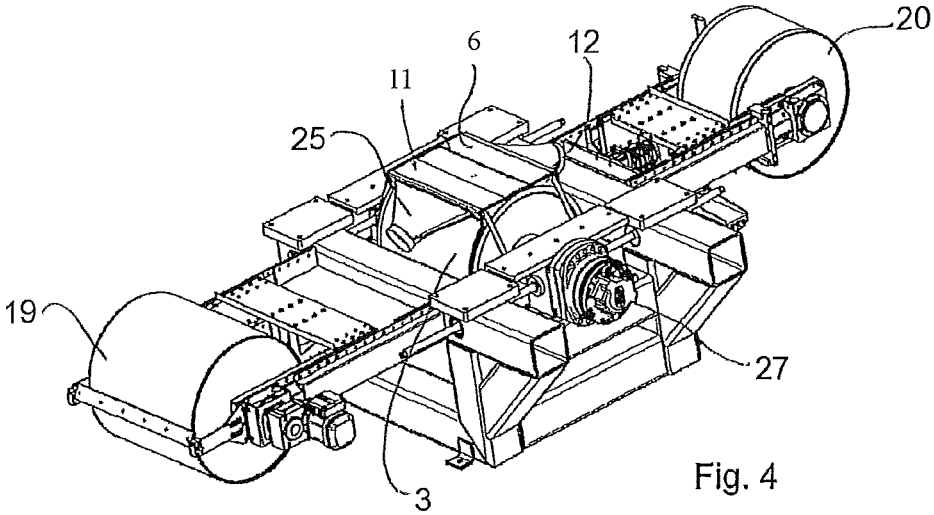
FIG. 4 shows, in perspective, the same embodiment as in FIG. 1 but with some parts removed.

As can be seen in FIG. 4, the suction device 6 extends in a direction parallel to the axis of the first roll 3. In the embodiment of FIG. 4, the suction device 6 has an axial length that is substantially as long as the axial length of the first roll 3. It is preferable that the suction device extends for at least the entire axial length of the first roll such that suction can operate over the entire axial length of the first nip. However, embodiments are conceivable in which the suction device is shorter and covers only a part of the axial length of the first roll 3. The suction device 6 is connected to a source of underpressure (not shown) such that suction can be applied in the delimited suction zone 26. When suction is applied to the delimited suction zone 26, water that has been pressed out of the wood chips 2 is sucked through the endless conveyor 5 which is permeable to water. In this way, water is removed from the area of the first nip $N_1$. This is important since water that has been pressed out of the wood chips 2 could otherwise be reabsorbed into the wood chips 2 as soon as the wood chips 2 leave the area of the first nip $N_1$. By placing the suction device 6 such that it sealingly engages both the outer surface 7 of the first roll 3 and the inner surface 8 of the endless conveyor 5, suction can be applied directly at the exit from or at the entry to the first nip $N_1$ depending on whether the suction device 6 is positioned downstream of or upstream of the first nip $N_1$. Thereby, water that has been pressed out of the wood chips 2 can be removed from the endless conveyor immediately which reduces the time during which water can be reabsorbed into the wood chips 2. With reference to FIG. 4, the suction device 6 may be connected to an evacuation duct 25 through which water is evacuated.

In principle, the first roll 3 could be designed as a suction roll with perforations in the roll shell. While it would be possible to use a suction roll with perforations in the roll shell, the use of a suction box operating through a permeable conveyor is less likely to result in clogging. Since the rolls used in the first nip $N_1$ are used for applying pressure to the wood chips 2, the roll shells must have a certain thickness in order to provide the necessary strength. As a consequence, the perforations in the roll shell (roll mantle) will be correspondingly long. This would inevitably increase the risk of clogging. When instead a separate endless conveyor is used which is permeable, the conveyor does not have to be very thick since it does not perform the same function as a roll. Therefore, the perforations/openings in the conveyor can be much shorter than the perforations in a roll shell would have to be. Therefore, the risk that the perforations would become clogged by debris from the wood chips is much smaller. It follows that a permeable endless conveyor and a suction device that is separate from the rolls in the first nip $N_1$ is a better solution than a suction roll. In the present invention, the first roll 3 is preferably a roll that has no perforations but instead a solid mantle (i.e. it is not a suction roll). Preferably, this applies also to the other rolls. A solid mantle for the first roll 3 (i.e. a mantle without perforations) is stronger than a perforated mantle and will allow higher forces to be used for dewatering. When higher forces are used, the dewatering can be more effective.

With reference to FIG. 4 and to FIG. 8*a*, the apparatus 1 preferably comprises a suction device 6, 11 on each side of the first nip $N_1$ in the direction of movement of the endless conveyor 5. As can be seen in for example FIG. 8*a*, a suction device 6 is positioned on one side of the first nip $N_1$ while a second suction device is positioned on the other side of the first nip $N_1$. In this way, water can be removed by suction on both sides of the first nip $N_1$. Thereby, the risk that water is reabsorbed by the wood chips 2 is further reduced.

Figure 5A:
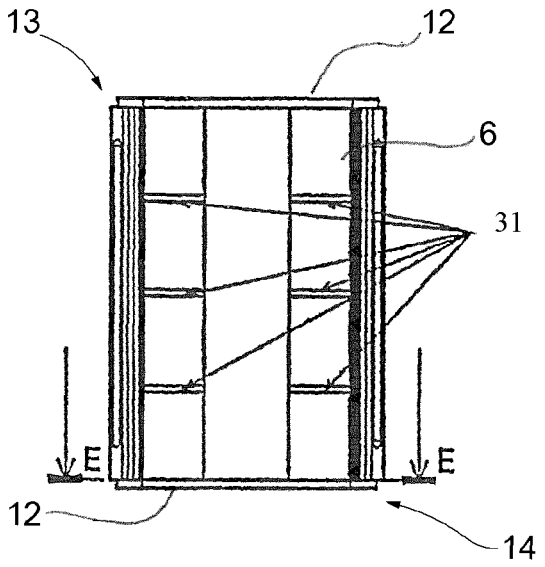
FIGS. 5*a*, 5*b*, 5*c* and 5*d* show a detail of a component shown in FIG. 4. It should be noted that FIG. 5*d* is an enlargement of the section marked "F" in FIG. 5*c*.
Figure 5B:
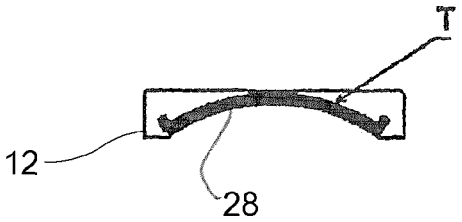
Figure 5C:
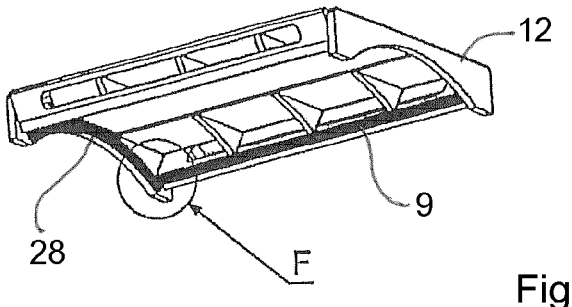
Figure 5D:
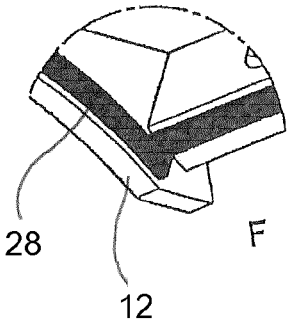
Figure 6:
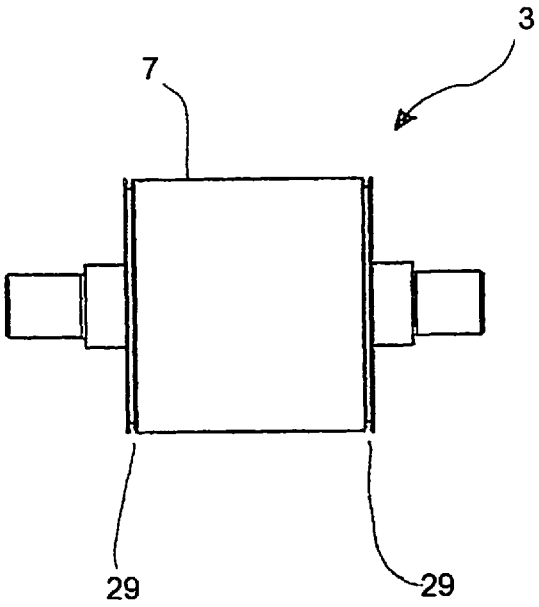
FIG. 6 shows a possible embodiment of a roll used in the invention.

With reference to FIG. 4 and to FIGS. 5*a* and 5*b* the at least one suction device 6 is further provided with an axial end wall 12 on at least one of the axial ends 13, 14 of the suction device 6. The axial end wall(s) 12 at the axial ends of the suction device 6 delimit the delimited suction zone 26 also at the axial ends of the at least one suction device 6 such that the delimited suction zone 26 is closed also at the axial ends of the suction device 6. Although the axial end walls(s) 12 at the axial end(s) of the suction device 6 is/are advantageous, embodiments are conceivable in which no such axial end walls 12 of the suction device 6 are used. When the axial ends of the suction device 6 are closed by end walls 12, the suction can work more effectively and water removal functions better. With reference to FIG. 5*b*, FIG. 5*c* and FIG. 5*d*, the end walls 12 of the at least one suction device 6 may be provided with curved seals 28 that can seal against the outer surface 7 of the first roll 3. With reference to FIG. 6, the first roll 3 may be provided with a circumferential groove 29 at its axial ends (embodiments are conceivable in which only one axial end of the first roll has such a groove 29). The curved seals 28 of the suction device 6 may extend into the circumferential grooves 29 at the axial ends of the first roll 3. The curved seals 28 may act against the bottom of the circumferential grooves 29 but preferably they contact a wall of each circumferential groove rather than the bottom of the groove. Such a sealing is believed by the inventors to be more durable and to give a better sealing effect.

As can be seen in FIG. 5*a*, the suction device 6 may be provided with stiffening elements 31 to improve the strength of the suction device 6.

The choice of material and dimensions for the endless conveyor 5 depend on the desired qualities of the conveyor. The conveyor must have a certain minimum strength and resist wear and abrasion. At the same time, it should be flexible and sufficiently permeable to water. It has been found that the endless conveyor may suitably be a steel band with a thickness in the range of 0.3 mm-2.5 mm, preferably a thickness in the range of 0.4 mm-2 mm. It is evident that the invention is not limited to the use of merely one conveyer 5, but it is foreseen that in some applications it may be an advantage to use two endless conveyers 5, i.e. one lower and on one upper, whereby may for example achieved an improved ability to move larger and or slippery particulate material into and through the nip N1.

A further possible benefit with using two conveyers is that it facilitates keeping some pressure on the material when making repeated compactions, it enables to merely release the pressure partly, which may reduce the needed compaction force in a subsequent nip. This may be especially desired in relation to "strong wood" (e.g. latewood) having thick cell walls that are the most difficult to soften and that contain most of the bound water. By allowing the pressure to decrease from a maximum compression to a desired level and then repeat this several times (nips) energy may be saved. Further, releasing completely the pressure after each nip may lead to overheating in thin walled "soft wood" (e.g. earlywood) maybe leading to undesired energy expense, in connection with using hot impregnation liquor, e.g. heated oil, (as will be described more in detail below).

Figure 2:
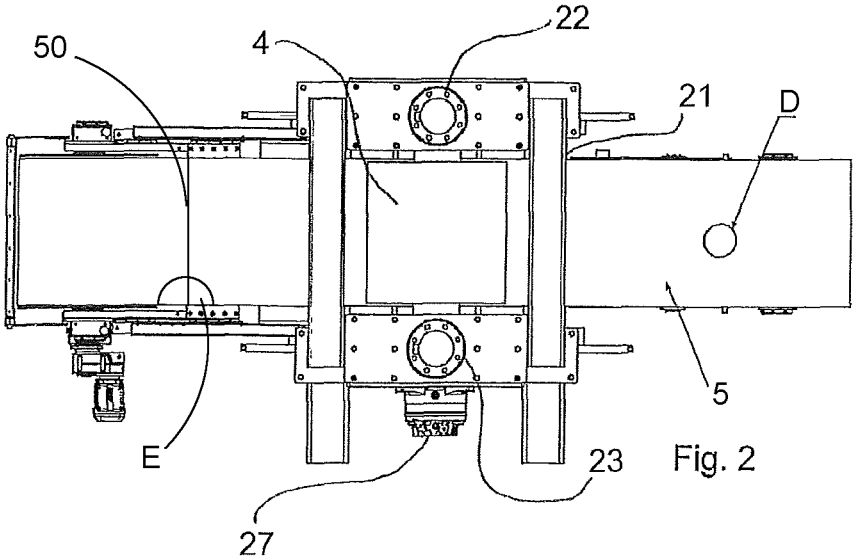
FIG. 2 is a view from above of the apparatus shown in FIG. 1.
Figure 3A:
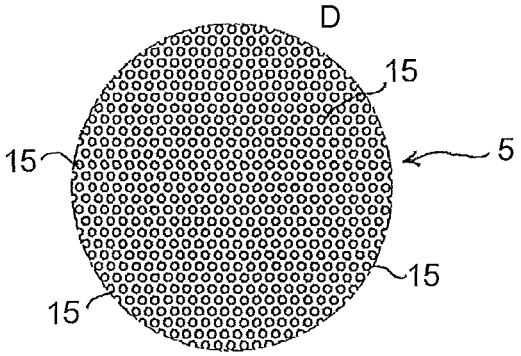
FIGS. 3A and 3B are an enlargements of the areas indicated by "D" and "E" in FIG. 2.

FIG. 3A shows the area indicated by "D" in FIG. 2 and represents a part of the top surface of the endless conveyor 5. As can be seen in FIG. 3, the endless conveyor 3 has perforations (through-holes) 15 through which water can pass such that the endless conveyor 5 is water permeable. Suitably, the endless conveyor 5 has perforations 15 with a diameter in the range of 0.5 mm-5.0 mm, preferably in the range of 10 mm-5.0 mm. The perforations 15 may have a circular (round) shape, and are preferably positioned according to an equilateral triangle hole pattern. An endless conveyor 5 with such perforations may have a good permeability to water, and also assists in moving wood material through the nip $N_1$ thanks to the combination of a great number of relatively sharp "grabbing" edges (formed by each hole) that have a high strength. Hence, these features assist in enabling the wood material to be moved into and through a nip $N_1$ where the high linear load may otherwise cause difficulties.

Figure 3B:
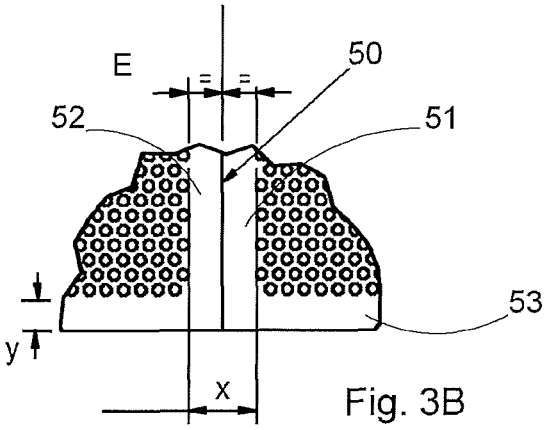

In FIG. 3B there is shown the area marked "E" in FIG. 2, presenting that the metal band 5 preferably is joined, to be endless, by means of a weld 50, and that preferably non perforated areas 51, 52 are arranged adjacent the weld 50. Preferably the non perforated area 51, 52 has a width, X in the range of 10-60 mm, more preferred 20-40 mm. Also at the sides/edges of the metal band 5 there preferably exist non perforated areas 53, having a cross extension of about 5-30 mm, more preferred 10-20 mm.

In the context of this patent application, the term "diameter" may have a meaning also for perforations with a non-circular shape (e.g. an elliptical, rectangular or triangular shape). For such perforations, the term "diameter" may be interpreted as meaning that a perforation having a certain diameter has such dimensions that its area (i.e. the area through which water and/or air can flow) equals the area of a circular perforation with this diameter.

Suitably, the endless conveyor 5 has an open area in the range of 10%-50%, preferable an open area in the range of 15%-45% and even more preferred an open area in the range of 25%-40%. Thereby, a good permeability to water is achieved while the endless conveyor may still have sufficient strength.

In one tested embodiment which has been contemplated by the inventor, the endless conveyor 5 may be a steel band (in particular a stainless steel band) with a thickness of 0.6 mm while the perforations 15 have a diameter of 3 mm and the total open area may be 32.6%.

As indicated in FIG. 7, a cleaning device 16 for the endless conveyor 5 may be placed inside the loop of the endless conveyor 5 and arranged to act on the endless conveyor 5 to remove debris from the endless conveyor 5. Thereby, clogging may be counteracted. The cleaning device 16 may be, for example, a rotating brush that acts continuously or intermittently against the inside surface of the endless conveyor 5 to remove debris from the perforations 15 in the endless conveyor 5. The cleaning device does not have to be a brush but could be, for example, a nozzle that ejects liquid or pressurized air on the surface of the endless conveyor 5. The cleaning device 16 must not necessarily act in the inner surface of the endless conveyor 5, it could also act on an outer surface of the endless conveyor 5. Optionally, more than one cleaning device 16 could be used. For example, one cleaning device 16 could be arranged to act on the inner surface 8 of the endless conveyor 5 while another cleaning device may be arranged to act on the outer surface of the endless conveyor 5.

Figure 9:
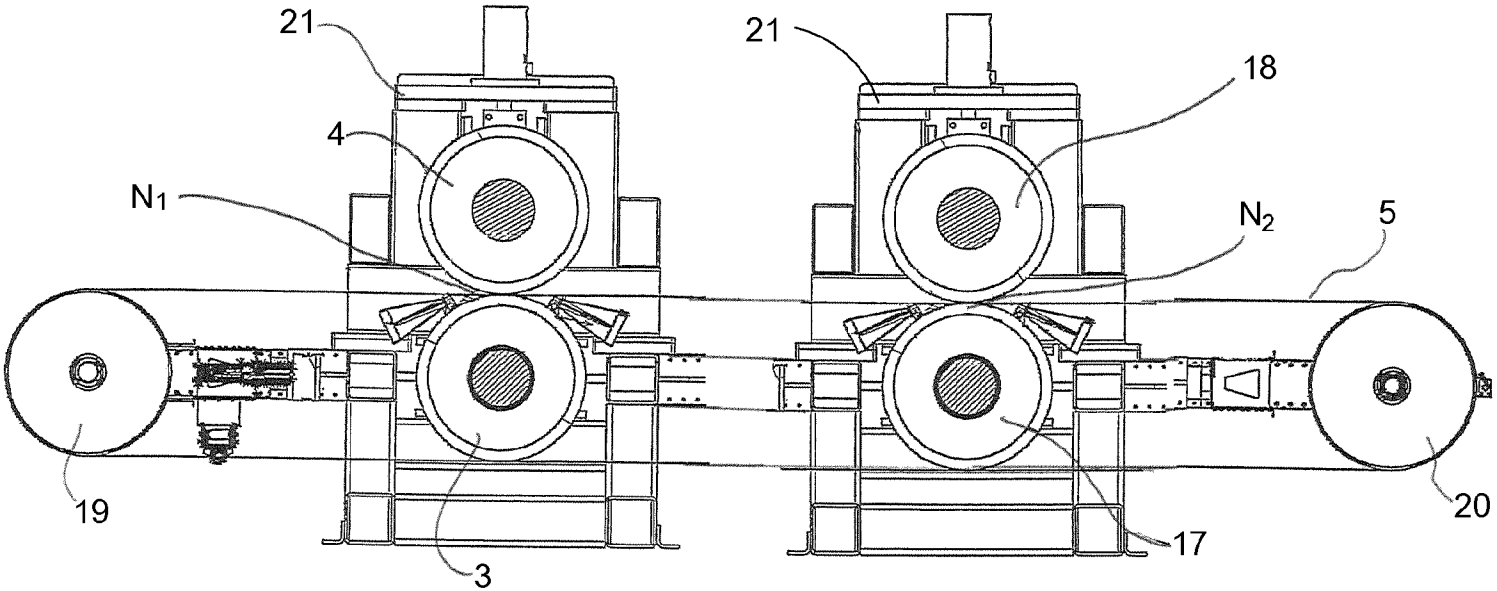
FIG. 9 is a cross-sectional side view similar to FIG. 7 but showing an alternative embodiment.

Another embodiment of the invention will now be explained with reference to FIG. 9. In the embodiment shown in FIG. 9, the inventive apparatus 1 further comprises a third roll 17 arranged within the loop of the endless conveyor 5 and a fourth roll 18 outside the loop of the endless conveyor 5. The fourth roll 18 is arranged to form a second nip $N_2$ with the third roll 17 to press water out of wood chips 2 that are passed on the endless conveyor 5 through the second nip $N_2$. The fourth roll 18 may be arranged to be driven with such a speed that its peripheral speed exceeds the speed of the endless conveyor 5. The advantage of this is that, when the fourth roll 18 moves faster than the endless conveyor 5, the wood chips 2 tend to become arranged such that their fibers will be oriented in substantially the same plane as the endless conveyor 5. This improves dewatering compared to the case where wood chips 2 are "standing" such that the fibers of the wood chips are oriented in the same plane as the forces in the nip. The force needed to press water out of the wood chips 2 is lower when the fibers are oriented in substantially the same plane as the endless conveyor. The inventors have found that a speed difference between the endless conveyor 5 and the roll that is located on the outside of the loop of the endless conveyor 5 has such an effect of orienting the wood chips 2 that dewatering is improved.

Figure 10:
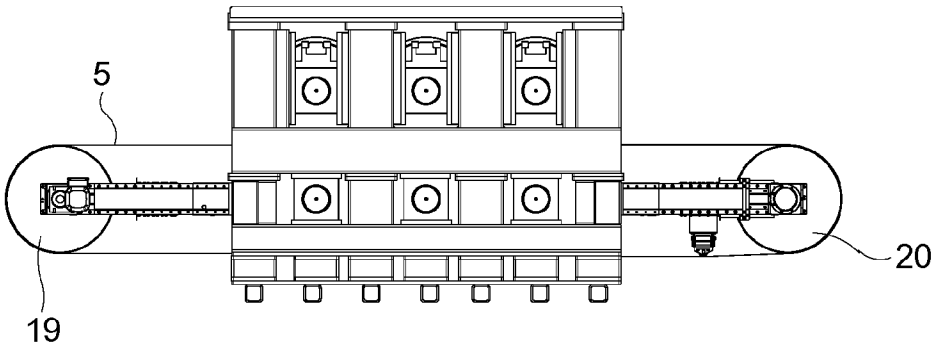
FIG. 10 shows yet another embodiment

With reference to FIG. 10, embodiments are also possible in which three nips are used. Also in such embodiments, the upper roll in the last nip may have a peripheral speed that exceeds the speed of the endless conveyor 5.

Embodiments are conceivable in which the apparatus 1 has only one nip and in which there is one a first roll 3 and s second roll 4 and in which the second roll 4 (the roll outside the loop of the endless conveyor 5) is driven with such a speed that the peripheral speed exceeds the speed of the endless conveyor 5. However, experience has showed that in embodiments with only one nip, it is difficult to drive one roll with a speed that is higher than the speed of the endless conveyor 5. When two nips are used (or more than two nips), the speed of the endless conveyor can be determined by the speed of the driven rolls in one nip while a higher peripheral speed can be used by a roll in the other nip (the roll that is located outside the loop of the endless conveyor 5). Therefore, it is easier to obtain a speed difference when two nips $N_1$, $N_2$ are used.

It should be noted that, in embodiments using a conveyor with perforations, the perforations in the endless conveyor 5 can contribute to holding the wood chips in the nip when the outer roll is driven with a peripheral speed that exceeds that of the endless conveyor 5. Also in such cases where both rolls in the nip are driven with the same peripheral speed, the perforations can serve the function of holding the wood chips. Thereby, it is possible to reduce the risk that some wood chips are pushed back when the reach the nip and form a small pile before the nip. Therefore, the perforations can contribute to increasing the output of the inventive machine.

During operation of the inventive apparatus, the suction device 6 or suction devices 6, 11 are operated during pressing of the wood chips 2 such that an under pressure is generated in the delimited suction zone 26 and water is sucked through the permeable endless conveyor. The water which has thus been sucked away from the nip passes through the suction device 6 which may have an evacuation duct 25 (see FIG. 4). During operation, the under pressure in the suction zone 26 may be on the order of about 100 millibar. For example, the under pressure maybe in the range of 90 millibar-300 millibar. However, other values for the under pressure are also possible. For each specific application, different levels may be tested and the skilled person is hereby encouraged to test whether a lower under pressure may be sufficient (which may save energy) or whether a higher level of under pressure may result in improved dewatering.

The endless conveyor 5 may be driven by the first and second rolls 3, 4 and/or by the third and fourth rolls 17 18. Alternatively, the endless conveyor 5 may instead be driven by one or both of the rolls 19, 20 (see FIG. 1). Optionally, all rolls shown in FIG. 1 or FIG. 9 that are in a position to act on the endless conveyor 5 may be operated to drive the endless conveyor 5. The endless conveyor 5 may be driven at a speed in the range of 0.3 m/s-10 m/s, preferably a speed in the range of 0.6 m/s-5 m/s. This speed is suitable for effective dewatering. At speeds that are too high, there is not time enough for the wood chips 2 to become sufficiently compressed. At speeds that are too low, the production rate will be unsatisfactory. In one embodiment contemplated by the inventors, the endless conveyor may be operated at a speed of about 1 m/s, to produce about 80-100 m3/hour, when using a 30 mm thick chip mat on the conveyer 5.

A linear load can be applied in the first nip $N_1$ which is in the range of 400 kN/m-1500 kN/m, preferably in the range of 500 kN/m-1000 kN/m. Such a force is sufficient for effective dewatering in many realistic cases. Here, it should be added that the required pressure may vary depending on the type of wood in the wood chips 2. Further the required load may be reduced by pre heating the wood material, since pre heating of the wood material will achieve softening, e.g. a preheating to 100° C. may reduce the required load by 30-50%.

In many practical applications, the nip may have a gap (distance between the press rolls) which, during operation, may be on the order of about 1 mm-10 mm, depending on the type of wood chips and other factors. Other dimensions are also possible.

Thanks to the invention, wood chips can be dewatered without excessive reabsorption of water after the press nip and clogging of the perforations through which water is sucked out is reduced.

The principle of using a speed difference between a roll and the endless conveyor to cause an orientation of the wood chips can be used also when no suction device is used. In embodiments without a suction device, the endless conveyor need not necessarily be permeable.

It should be understood that everything which has been said about the at least one suction device 6 on one side of a nip may also apply to the suction device located on the other side of the nip (if there is a suction device on both sides of the nip).

Figure 12:
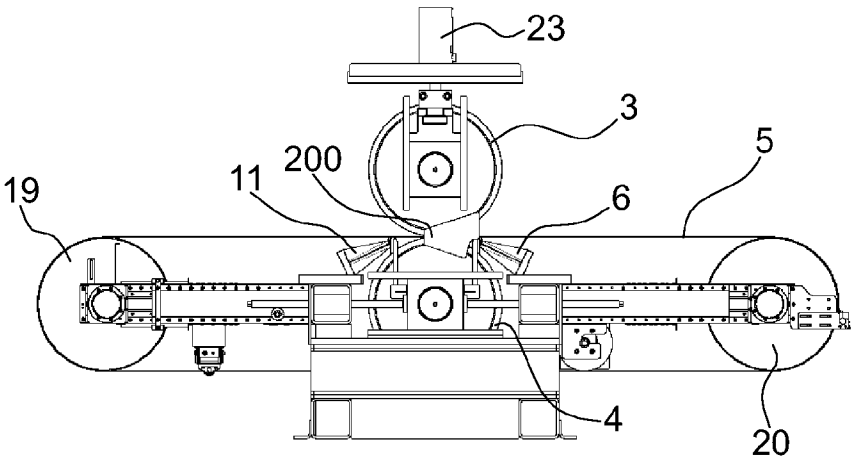
FIGS. 11, 12 and 13 show yet another embodiment.
Figure 11:
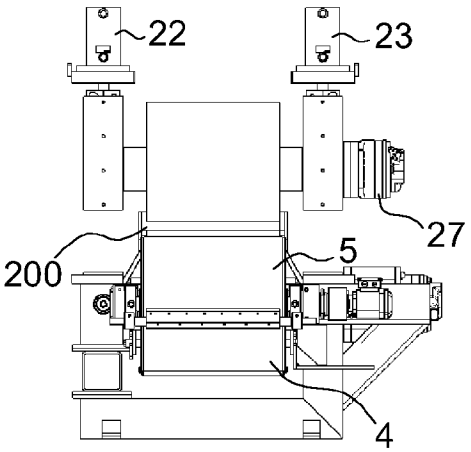
Figure 13:
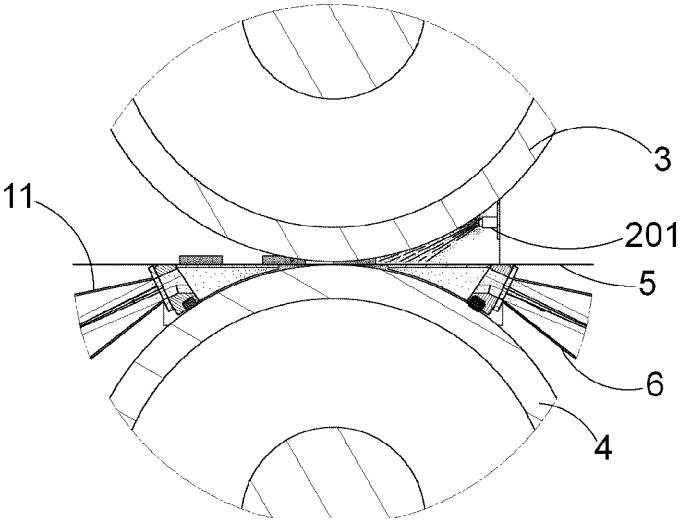

In FIGS. 11, 12 and 13 there is a shown modified embodiment in accordance with the invention. In the modified embodiment there is arranged an impregnation device 200, e.g. in the form of a steam box 200, adjacent the nip. The steam box 200 is arranged with a steam supply 201, in the form of a continuous slot, or discrete nozzles that spray steam into the backside of the nip. By means of the arrangement 200, 201 overheated steam, preferably in the range of 180-220° C. is supplied to the wood chips in the nip. Thanks to the supply of overheated steam a kind of visco elastic thermal compression will occur. This in turn will lead to a mechanosorptive effect that will further reduce the moist content contained by the wood chips. The reason is that 25-40% of the moisture in woodchips are contained in the cell walls and that moist may not easily be removed by means of compression in itself, but needs heat to be removed, which is achieved by means of supplying the overheated steam in accordance with the modified embodiments of the invention. Hence the manner of using this novel functional principle would generally be as follows. Firstly the chips are compressed (as described above) in the nip by the rolls 3, 4. In connection with the compression the elasticity of the wood chips will lead to expansion, which in turn will make the chips absorb the surroundings superheated steam and thereby evaporate substantial amount of the contained remaining moisture to further decrease the moist content of the wood chips. The superheated steam is continuously supplied via the steam supply 201 and continuously removed by means of the suction devices 6, 11.

According to a further modification in accordance with the invention the visco elastic recovery of wood chips may also be used to impregnate woodchips with different kind of liquids. e.g. impregnation liquid prior to introduction into a digester. The elastic recovery provides a suction force leading to intense soaking of the liquid in the impregnation device 200 into the chips voids and will therefore lead to a much more efficient impregnation than in conventional methods. A surprising efficiency may be achieved, e.g. instead of appr. 90 min for sufficient impregnation it may be obtained in less than 5 seconds, or even less, in fact test have shown that it may be obtained in less than 1 second in practice the impregnation occurs more or by instantaneously, and will be "controlled" by the speed of the conveyer 5. It is evident for the skilled person that this principle may be used in connection with different processes related to treatment of wood chips, e.g. in connection with producing pulp (e.g. impregnation liquor), in connection with producing chip boards, brickets, pellets, etc. In many applications it may be preferred that oil and moisture is separated and that the oil is reused in the process.

Furthermore, the invention may be used to produce bio mass fuels, e.g. for gasification, having an extremely low content of moisture, by using an appropriate impregnation liquid to force more moisture out of the fibers. An appropriate impregnation liquid preferably implies a viscosity greater than water, for example oil. In one embodiment the latter 3 is obtained by supplying oil into the impregnation device 200, whereby in a first step that oil is soaked up into the material, i.e. filling the voids (the lumen) of the fibers. In a subsequent nip/step the oil together with moisture will be pressed out from the material, enabling to easily reach a moisture content below 27%. By using hot oil (e.g. 200° C., instead of cold) it is feasible to easily reach below 25%, and even below 20% in one step. By iterating the process, an extremely low moisture content may be achieved, e.g easily as low as below 19%. Indeed, in principle any moisture content, MC, is possible depending on the number of runs, temperature and impregnation liquid. In the table there is shown that very positive results may be achieved by means of the invention.

| Test [Nr] | MC Start [%] | MC Finish [%] | Other |
|---|---|---|---|
| Reference 1 | 63.6 | 63.6 | For reference only to be used as starting MC for rest of the samples. Material was not processed. Sample was dried for 24 h in oven in 103 ± 2° C. to determine starting MC. |
| Reference 2 | 64.8 | 64.6 | For reference only to be used as starting MC for rest of the samples. Material was not processed. Sample was dried for 24 h in oven in 103 ± 2° C. to determine starting MC. |
| 1 | 63-65 | 35.1 | Pressed once |
| 2 | 63-65 | 36.1 | Pressed once |
| 3 | 63-65 | 25.7 | Pressed once then impregnated with cold oil and then pressed again. |
| 4 | 63-65 | 26.4 | Pressed once then impregnated with cold oil and then pressed again. |
| 5 | 63-65 | 24.6 | Pressed once then impregnated with cold oil and then pressed again. |

-continued

| Test [Nr] | MC Start [%] | MC Finish [%] | Other |
|---|---|---|---|
| 6 | 63-65 | 18.1 | Pressed once then impregnated with cold oil, pressed again, then impregnated with hot (temperature 200° C.) oil and pressed again. |
| 7 | 63-65 | 13.4 | Pressed once then impregnated with cold oil, pressed again, two cycles with impregnation of hot oil (temperature 200° C.) and pressing to get rid of oil. |

Furthermore the impregnating liquid may be used to modify the content of the processed fibrous material, e.g. by producing wood chips to be used as fuel, and using oil as an impregnation liquid, so that the fuel value may be increased.

Figure 14:
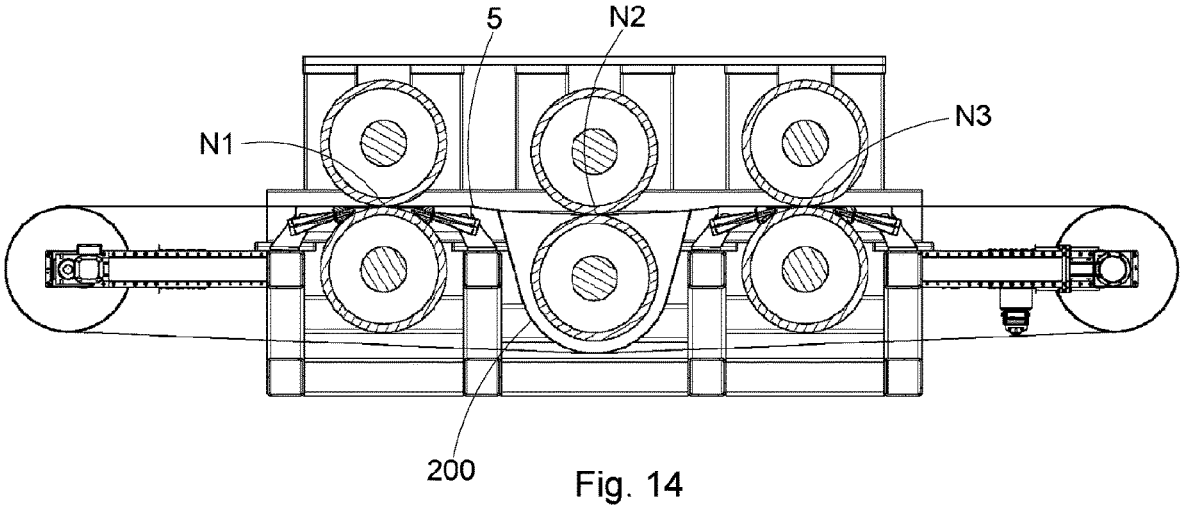
FIG. 14 shows yet another embodiment.

In FIG. 14 there is a shown a further modified embodiment in accordance with the invention, wherein an impregnation device 200 is used in combination with three nips N1-N3. In this embodiment the impregnation device 200 is in the form of vat containing an impregnation liquid, e.g. oil. In order to allow the material 2 on the conveyer 5 to easily move down and up into the impregnation vessel 200, and thereby having the wood material 2 immersed in the impregnation liquid within and adjacent the second nip N2, the second nip N2 is preferably positioned at a lower level than the neighboring nips N1 and N3. Moreover, FIG. 14 presents that the use of a suction device is no necessity for obtaining beneficial results with an apparatus in accordance with the invention. It does improve on dewatering, but in many applications that dewatering is not necessary/desired, and especially if the process is combined with an impregnation device 200, a suction device may be superfluous, since the moisture content may still be reduced down to very low levels, as is evident from the above.

It is foreseen that this application may be the subject matter for numerous divisional applications, having claims focusing on different aspects of the inventive concept, e.g. one focusing on the aspect of using a suction device (with or without impregnation and/or metal band conveyer) one focusing on using a conveyer in the form of a metal band (with or without impregnation and/or a suction device) and one focusing on using an impregnation device (with or without a suction device and/or metal band conveyer).

A further beneficial result of the invention is that the processed material will be much softer than the raw material (e.g. wood chips) and indeed become spongy Thanks to this outcome the processed material will be more easy to handle in many situations, e.g. in connection with baling. In fact test have shown that bales may easily be produced having a density above 1000 kg/m$^3$.

In the table below it is presented the result of tests with three different batches of material, here wood chips, wherein each batch is compressed with the same press force prior any treatment and after treatment, respectively, to measure the compressed height of the batch before and after treatment respectively. Different press forces have been used in the different tests. It has been observed that despite using different press forces the gain in compression ratio will always be more than 25% when using a press force within the range of 1.5-10 kg/cm$^2$, which is a substantial advantage in many cases, e.g. regarding space requirement during transport. Furthermore, it is interesting to note that the gain is larger when the press force is in the lower range, i.e. below 5 kg/cm$^2$ since this opens up options to use compacting equipment, providing relatively low compression forces, e.g. baling machines used for other purposes, e.g. baling of hay.

| Test [Nr] | Press force [Kg/cm$^2$] | Sample area [mm$^2$] | Sample height unprocessed material [mm] | Sample height processed material [mm] | Ratio Processed/ Unprocessed |
|---|---|---|---|---|---|
| 1 | 9.65 | 5281 | 26 | 18 | 0.69 |
| 2 | 4.73 | 5281 | 37 | 26 | 0.70 |
| 3 | 1.89 | 5281 | 46 | 28 | 0.61 |

Moreover, the fiber material will also become partially defibrated, which may provide significant advantages, e.g. in connection with pulp production, especially Mechanical Pulp, by reducing the subsequent need of treatment (chemicals and/or power) to achieve sufficient defibration.

While the invention has been described above in terms of an apparatus and a method, it should be understood that these categories only reflect different aspects of one and the same invention. Therefore, the method may include such steps that would be the inevitable result of using features/components of the apparatus.

Although the inventive method and apparatus is mainly intended for treatment of wood chips it is evident that it may also be used for similar purpose for treatment of other materials, e.g. sawdust, bark, hog fuel, etc. Further the inventive apparatus may also be used for other purposes than dewatering, e.g. it may also be used for compressing already dried wood chips, i.e. for densification of the chips. Very dry wood chips having a water content of 12% or less do not spring back very much when they are compressed. This can be used to increase the density of wood chips such that the wood chips become less bulky. The compressed wood chips may then be transported more easily from one place to another. Such compressed wood chips may be burned to produce heat. For the purpose of compressing already dried wood chips, the endless conveyor need not be permeable and the suction box would probably serve no purpose.

Figure 15:
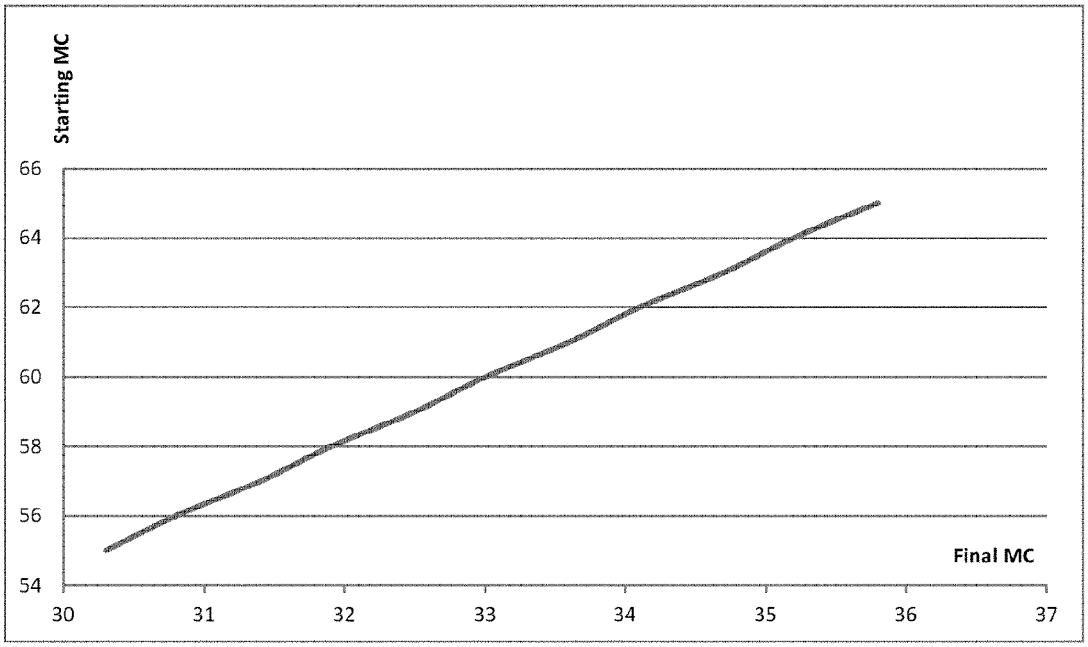
FIG. 15 shows a diagram that presents how efficient reduction of the moisture content may be achieved with the invention.

However, one main advantage of the invention lies in its good capacity for dewatering wood chips. In a test carried out by the inventors, wood chips having a moisture content (MC) of 55-65% were dewatered down to a water content of 28-35%, wherein of course a lower starting MC will help to reach a lower end MC, as is presented in FIG. 15 and the table below.

| Final MC | Starting MC |
|---|---|
| 35.8 | 65 |
| 35.2 | 64 |
| 34.7 | 63 |
| 34.1 | 62 |
| 33.6 | 61 |
| 33 | 60 |
| 32.5 | 59 |
| 31.9 | 58 |
| 31.4 | 57 |
| 30.8 | 56 |
| 30.3 | 55 |

The invention claimed is:

1. A method of dewatering wood material (2), the method comprising:

passing the wood material (2) through at least a first nip (Ni) formed between a first roll (3) and a second roll (4) such that water in the wood material (2) is pressed out of the wood material (2) when the wood material (2) passes through the first nip (Ni), carrying the wood material (2) through the first nip (Ni) on an endless conveyor (5) comprising an endless sheet metal band having a thickness in a range of 0.4 mm to 2.0 mm which is permeable to water through perforations having a diameter in a range of 1.0 mm to 5.0 mm formed in the endless sheet metal band and which forms a single loop around the first roll (3);

wherein a linear load in kilonewtons (kN) of force per distance in meters (m) of a length of the nip extending in a line parallel to a longitudinal axis of the first roll is applied in the first nip (Ni) which is in the range of 500 kN/m-4000 kN/m, wherein the endless conveyor (5) has a speed in a range of 0.6 m/s to 5 m/s, and wherein the water that has been pressed out of the wood material is sucked through the perforations formed in the endless conveyor by at least one suction device which is located inside the loop of the endless conveyor and said at least one suction device extends in a direction parallel to the longitudinal axis of the first roll.

2. The method according to claim 1, wherein a linear load is applied in the first nip ($N_1$) which is in the range of 800 kN/m-3000 kN/m.

3. The method according to claim 1, wherein a cleaning device (16) inside the loop of the endless conveyor (5) is operated to remove debris from the endless conveyor (5).

4. The method according to claim 1, wherein the endless conveyor (5) passes through a second nip ($N_2$) arranged downstream of the first nip ($N_1$), the second nip ($N_2$) being formed by a third roll (17) positioned inside the loop of the endless conveyor (5) and a fourth roll (18) positioned outside the loop of the endless conveyor (5); and wherein the fourth roll (18) is driven with such a speed that a peripheral speed of the fourth roll (18) exceeds the speed of the endless conveyor (5).

5. The method according to claim 1, wherein overheated steam is supplied to the wood material (2) after having passed the first nip ($N_1$) to dewater the wood material (2) further.

6. The method according to of claim 1, wherein a liquid is supplied to the wood material (2) after having passed the first nip ($N_1$) to soak the wood material (2) in connection with an elastic recovery of wood material (2) after passing the first nip.

7. The method according to claim 1, wherein the at least one suction device sealingly engages an outer surface of the first roll such that, a delimited suction zone is formed in an area between the at least one suction device, the outer surface of the first roll and the endless conveyor and in that the at least one suction device is operated during pressing such that an underpressure is generated in the suction zone, wherein the at least one suction device is used on one side of the first nip and at least one other suction device is used on another side of the first nip.

* * * * *